United States Patent [19]

Koike et al.

[11] 4,442,876

[45] Apr. 17, 1984

[54] APPARATUS FOR DRYING VENEER SHEET

[75] Inventors: Masaru Koike; Yasumasa Hasegawa; Satoru Shimosaka; Nagara Aoyama; Toshihiko Yoshizumi, all of Ohbu, Japan

[73] Assignee: Meinan Machinery Works, Inc., Ohbu, Japan

[21] Appl. No.: 425,924

[22] Filed: Sep. 28, 1982

Related U.S. Application Data

[62] Division of Ser. No. 176,995, Aug. 11, 1980.

[30] Foreign Application Priority Data

Aug. 20, 1979 [JP] Japan ..... 54-106408
Dec. 8, 1979 [JP] Japan ..... 54-159423

[51] Int. Cl.[3] ..... B27M 1/02
[52] U.S. Cl. ..... 144/2 R; 34/114; 34/116; 144/362; 144/380
[58] Field of Search ..... 144/2 R, 209 R, 213, 144/360, 362, 380; 34/116, 114, 122

[56] References Cited

U.S. PATENT DOCUMENTS

| | | | |
|---|---|---|---|
| 1,573,379 | 2/1926 | Elmendorf | 34/114 |
| 1,578,020 | 3/1926 | Elmendorf | 34/114 |
| 2,815,779 | 10/1957 | Higgins | 144/362 |
| 2,815,780 | 10/1957 | Higgins | 144/362 |
| 4,269,243 | 5/1981 | Hasegawa | 144/213 |

*Primary Examiner*—W. D. Bray
*Attorney, Agent, or Firm*—Balogh, Osann, Kramer, Dvorak, Genova & Traub

[57] ABSTRACT

A method of drying a veneer sheet is provided. The method comprises the steps of tenderizing, compressing, and drying a veneer sheet. The compressing and drying steps are performed at the same time. The tenderizing step is preferably be performed before the above two steps but may be done thereafter or at the same time. An apparatus for performing the method is also disclosed. The apparatus comprises tenderizing means, deceleration transfer means, and heating means. The deceleration and the heating means are combined into one section. A plurality of rollers are used as deceleration transfer means.

4 Claims, 23 Drawing Figures

APPARATUS FOR DRYING VENEER SHEET

This is a divisional of application Ser. No. 176,995, filed Aug. 11, 1980.

BACKGROUND OF THE INVENTION

The present invention relates to a method and apparatus for drying a sheet of veneer and contemplates providing a rationalized drying technique which minimizes or practically eliminates splitting in a veneer sheet which conventionally resulted from such treatment.

Traditionally, a process for producing plywood includes a step of drying veneer sheets with a drier. When dried, however, veneer sheets crack concentrically at irregularly distributed spots and become very poor in quality even though they may have been of favorable quality before the drying step. Cracked parts of veneer sheets must be cut off and wasted with the resultant decrease in the yield and this critically reduces the output from veneer sheets.

To cope with this problem, there has been proposed and put to practical use, though in a minor part of the industry, a process by which a veneer sheet is first formed with numerous short slits to be tenderized and then allowed to go on the drying step (referred to as the "Y process" hereinafter). Compared with the process without tenderizing (referred to as the "X process" hereinafter), the Y process somewhat decreases the tendency of veneer sheets to split concentrically during drying and has given an acceptable result so far. However, such a technique is not fully acceptable in that it still fails to entirely eliminate splits attributable to the drying step.

It is apparent that the splits in a veneer sheet caused by drying and commonly observed in the conventional processes result from contraction of the veneer sheet when subjected to such treatment. Where the conveying members within a drier comprises upper and lower nets as in a net drier for example, they obstruct the contraction of a veneer sheet which should be allowed gradually in the course of the drying step and allow stresses to develop within the veneer sheet. The veneer sheet breaks or cracks in locations where the stresses are the most concentrated. With this in view, the Y process employing tenderizing process is designed to avoid cracks by decentralizing the stresses in the veneer sheet by means of numerous short slits and thereby reduce the tendency of splitting as a whole. Extended studies which we made to determine the benefit of tenderized veneer sheets showed that the range of elasticity in which a veneer sheet stretches without splitting when pulled in a direction perpendicular to its grain is larger in tenderized sheets than in non-tenderized sheets.

SUMMARY OF THE INVENTION

The present invention has been achieved on the basis of the above-mentioned finding. An object of the present invention is to improve the quality and yield from veneer sheets by precluding or minimizing splits attributable to drying. This will eliminate the discussed problems originating from the drying step in the plywood industry, which has suffered from a shortage in the supply of logs. Another object of the present invention is to establish the basis for automatic operation in drying and other procedures subsequent to drying by giving a favorable elastic property to veneer sheets.

DETAILED DESCRIPTION OF THE PREFERRED EMBODIMENTS

Figure 1:
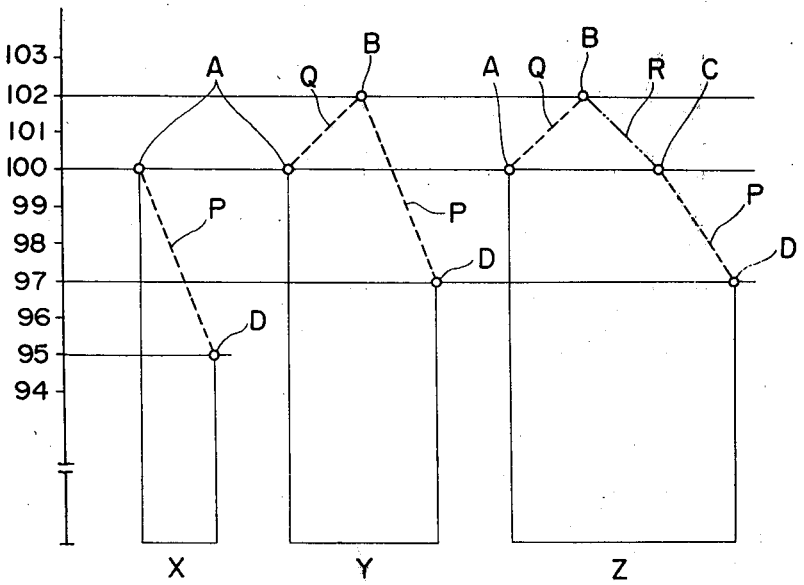
FIG. 1 is a plot explanatory of the present invention in comparison with prior art.

A basic process according to the present invention will be described with reference to FIG. 1. Lines in FIG. 1 demonstrate for comparison the X and Y processes typifying the know drying processes and the Z process embodied by the present invention. The reference level "100" on the ordinate indicates the free length of a veneer sheet just cut from a log by a known veneer lathe in a direction perpendicular to its grain (the veneer sheet having cracks at its back but not on its front or no secondary cracks). The X process includes drying P along, the Y process includes tenderizing Q and drying P, and the Z process of the invention includes tenderizing Q, compressing R and drying P. In these processes, the reference character A denotes a non-processed veneer sheet having only back cracks, B a tenderized veneer sheet having numerous short slits, C a compressed veneer sheet and D a dried veneer sheet. The length of veneer sheets vary as illustrated when treated by the three different processes X, Y and Z. Now, what has primary importance to promote understanding of the present invention is whether the changes in length can occur within the ranges of elasticity for the veneer sheets. For instance, with the prior art process X, a veneer sheet undergoing the drying step tends to shrink by 5% (average value) despite the elasticity range of substantially 1% of the veneer sheet A as determined by experiments. Stated another way, the veneer sheet A tends to shrink 4% beyond the elasticity range and is therefore quite liable to crack during the drying step. According to the other prior art process Y, the veneer sheet A is tenderized by numerous short slits before being dried to obtain an expansion rate of 2% while the elasticity range will then have extended to substantially 3.5% as discussed. Therefore, the subsequent drying step P causes the veneer sheet A to shrink by 5% which exceeds the elasticity range by 1.5%. This is less serious than in the process X but still involves the possibility of cracking. It will therefore be seen that the conventional processes commonly fail to free veneer sheets from the possibility of splitting due to drying and that splits always appear when they are retained strongly as by securing opposite ends thereof perpendicularly to the grain. In this respect, the technique for reducing the retaining load on veneer sheets has just been the technique for preventing splits during drying in various types of known driers. Indeed, this will be understood from the fact that net driers, roll driers and other predominant driers now in use are commonly of the hot air circulation type which blows hot air onto the veneer sheets to avoid strong restraint thereon.

Meanwhile, the Z process of the present invention includes the compression of R between the tenderizing step Q and the drying step P as shown in FIG. 1. More specifically, veneer sheet A in the illustrated example has its proportion stretched by the tenderizing step Q, reduced by the compression step R to give a compressed veneer sheet C, and followed by the drying step P. The veneer sheet maintaining an elasticity range of 3.5% undergoes a 2% compression and then drying at which point it starts shrinking. Then, the compression in the veneer sheet is released when 2% of the 5% contraction has been completed while the remaining 3% of contraction is accommodated by the potential 3.5% of elasticity range of the veneer sheet provided by the tenderizing step. The process Z can thus practically eliminate the possibility of splitting during the drying step by confining the contraction to within the range of elasticity. The splitting can be avoided even though the drier may exert a relatively heavy restraining load on the veneer sheet. Additionally, the process Z opens up the road to the practical use of driers of the type which brings veneer sheets into direct contact with heated plates and efficiently dries them with relatively intense restraining force.

Such prevention of splits obtainable with the present invention is derived from the effective combination of tenderizing and compressing with drying as in the Z process. Basic prerequisites concerning this combination are that tenderizing takes place during or before drying and that compression occurs during drying. With this principle, the short range of elasticity relative to the amount of contraction is compensated for by the tenderizing and compressing steps and, hence, splits which would otherwise occur can be avoided when the contraction exceeds the elasticity range. Tenderizing if done without any assistance would greatly reduce the elasticity range as already stated. Compression when employed alone would be needed in an excessively large amount and, in view of the difficulty presented in compressing various types of veneer sheets with differing contraction rates, a wide range of compression force would be required to accommodate all of them. This degree of compression tends to damage veneer sheets and such tendency can not readily be prevented. The combination according to the present invention permits the two different kinds of process to mutually reduce their necessary degree of treatment to such an extent that the individual processings, particularly the compression, can be performed with ease. Thus, the present invention prevents the splitting of veneer sheets easily and effectively. Another advantage is derived from the inherent combination of the elasticity range provided by tenderizing and that provided by compression. Since the elasticity range as a whole is freely selectable because of the combination of the determined elasticity range (provided by compression) and the free one (provided by tenderizing), it can accommodate any irregularity in the compression distribution of veneer sheets and, therefore, can also accommodate with ease any contraction which may differ from one location to another on a veneer sheet. With this advantage, the contraction of veneer sheets can be easily accommodated over a wide range to favorably fit the properties of the veneer sheets. For example, the Z process shown in FIG. 1 achieves the desired effect without any adjustment even though the contraction rate may range from 2% to 5.5%.

In accordance with the present invention, a veneer sheet may be tenderized and then compressed, or compressed and then tenderized, or tenderized and compressed at the same time. However, the process wherein tenderizing precedes compression is more desirable than other procedures since, where tenderizing stretches a veneer sheet as in Z process of FIG. 1 for example, at least the stretched proportion of the veneer shhet can be compressed with ease. Preferred examples of the entire process employing such a favorable order of tenderizing and compressing are a process wherein tenderizing occurs before drying and then compression occurs during drying and a process wherein tenderizing occurs during the drying process and then compression takes place. In a case where the tendering and compressing take place in the opposite order or in an overlapped manner, they will proceed in the course of drying since the compression must occur during drying in any case. Compared with the ideal order, such alternative sequences present difficulty in the compression for compressing a veneer sheet in a direction perpendicular to its grain or maintaining the compressed state of the veneer sheet. Nevertheless, the alternative processes can be readily designed in view of the fact that the necessary amount of compression is far smaller than in the process employing compression along.

The elastic property of veneer sheets will be discussed in greater detail in combination with a desirable manner of tenderizing with reference to FIGS. 2–6.

Figure 4:
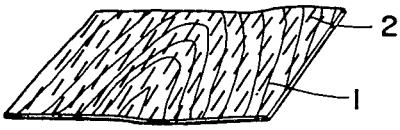
FIGS. 4 and 5 are perspective views of tenderized veneer sheets.
Figure 5:
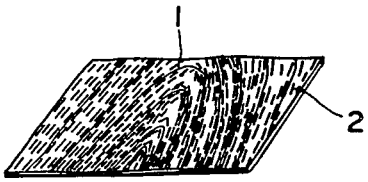

It appears that the elastic property of veneer sheets originates from various kinds of cracks distributed therein. When pulled by hands, a veneer sheet has such cracks enlarged sufficient to pass visible light rays therethrough. Particularly, an increased number of transmitted light rays are visible when a suitable degree of tenderizing is applied to a non-processed veneer sheet having cracks only on its back. This is sufficient to provide that tenderizing increases the range of elasticity. Further observation will show that the elasticity results from bending actions of, for example, narrow elongate portions of wood finely divided by the numerous cracks. FIG. 4 depicts a tenderized veneer sheet formed with splits or slits 2 regardless of its grain 1 (indicating the direction of the grain) by, for example, a roller having a number of piercing elements in the form of cutting edges. FIG. 5 shows another tenderized veneer sheet whose slits 2 extend substantially along the grain without damaging the fibers. The tendency of elasticity concerned here is enhanced more stably in the veneer sheet of FIG. 5 having the fibers unbroken than in the veneer sheet of FIG. 4 having the fibers cut apart. However, the veneer sheet of FIG. 5 tends to permit the slits or splits provided or enlarged by tenderizing to run together and turn into large cracks. In this respect, the veneer sheet of FIG. 4 is desirable because artificial distribution of slits is easy. A veneer sheet tenderized in any of the two illustrated manners has been proved to gain far more elasticity than any non-tenderized veneer sheets. The present invention proposes a process and apparatus which, as will be described hereinafter, has combined advantages of the two tenderizing methods to give veneer sheets a particularly favorable enlarged range of elasticity.

The process of the present invention includes primary tenderizing and secondary tenderizing which may occur simultaneously with, or after the primary tenderizing. For the primary tenderizing, a veneer sheet is formed with preferably distributed pierced flaws by piercing elements or cutting edge elements on the periphery of a roller or suitable means is employed to form small flaws (or short slits) from which splits can start. In the secondary tenderizing, splits tending to extend along the fibers of the veneer sheet are formed as by an apparatus shown in FIGS. 2 and 3. This process employing two simultaneous or successive stages of tenderizing suppresses irregular communication of adjacent splits and permits the splits to be distributed in the manner shown not in FIG. 6(*b*) but in FIG. 6(*a*).

Figure 6A:
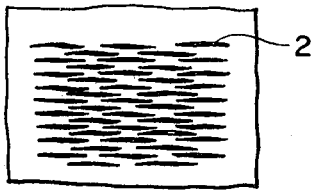
FIGS. 6*a* and 6*b* are enlarged views of splits formed on other tenderized veneer sheets.
Figure 6B:
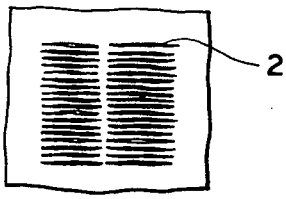

Naturally, it is preferable for the splits to run to the pattern of FIG. 6(*a*) than to that of FIG. 6(*b*) and most preferable if they extend along the grain of the wood. This most preferable pattern will also increase the elasticity range to a significant degree.

Figure 2:
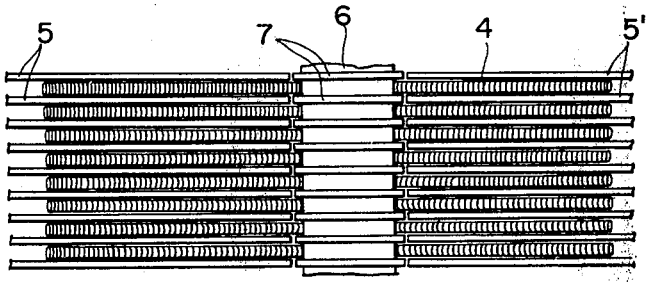
FIGS. 2 and 3 show the tenderizing device in plan and front elevation, respectively.
Figure 3:
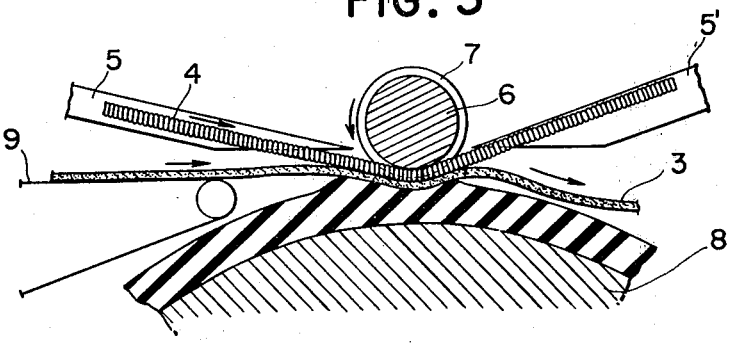

Referring to FIGS. 2 and 3, there is shown a tenderizing apparatus which has been newly developed in connection with the present invention. The apparatus includes a roller 8 whose outer periphery is covered with a layer of elastic material such as rubber, and a small diameter roller 6 having a number of recesses 7 adapted to guide elongated coil springs 4 therein. In operation, the rollers 6 and 8 rotating as indicated by arrows nip a veneer sheet 3 therebetween and feed it in the direction also indicated by the arrow. Then pressurizing means (not shown) associated with the roller 6 or 8 applies a pressure to the moving veneer sheet 3 while the elongated coil springs 4 move as indicated by the arrow in contact with the periphery of the roller 6 with a relatively small radius of curvature to be opened individually, thereby making the veneer sheet 3 tenderized. More specifically, this tenderizing device employs an improved version of Elemendorf's tenderizing system, that is, it utilizes in combination with Elemendorf's principle the opening actions of outer portions of the adjacent turns of each coil spring 4 relative to each other which occur when the coil springs are guided within curvature. The device therefore stretches the veneer sheet 3 from opposite sides thereof while forming or enlarging splits by bending, tenderizing the veneer sheet with favorably small pitches. The tenderizing device additionally includes guide members 5 and 5' for the veneer sheet and a conveyor 9 for feeding the veneer sheet.

It should be borne in mind that the "tenderizing" implies herein is not only forming or enlarging numerous small splits which can stretch a veneer sheet. Even if a processed veneer sheet does not show any expansion, it suffices that the veneer sheet bears numerous small splits (inclusive of pierced flaws and flaws formed by a knife-like tool) to have its range of elasticity increased in a direction perpendicular to the direction of the grain.

Now, compression of a veneer sheet will be described in connection with a system for carrying out the discussed process according to the present invention.

Figure 7:
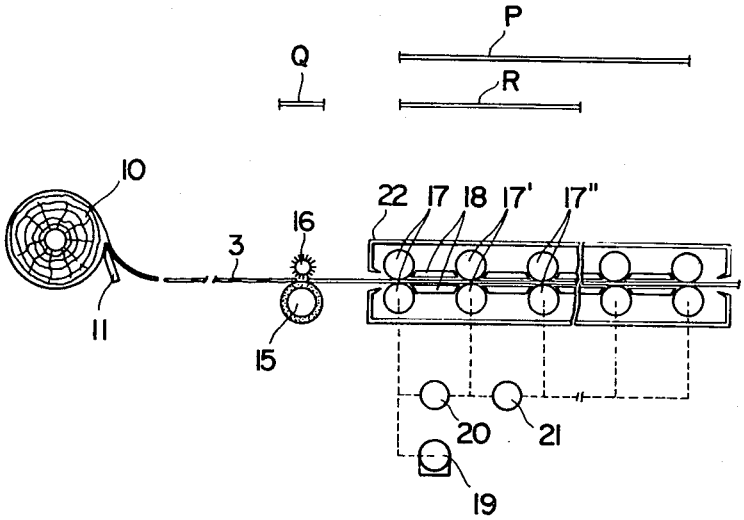
FIG. 7 illustrates a preferred embodiment of the present invention.

Referring to FIG. 7, a veneer sheet processing system is shown to include a tenderizing device whose major part consists of an anvil roller 15 and a tenderizing roller 16 having a number of cutting edge elements thereon. This tenderizer is followed by a transfer path defined by numerous roller pairs such as 17, 17' and 17" and guide plates 18 each intervening between adjacent roller pairs. While it is not always necessary to connect the transfer path with the tenderizer 15, 16 by a conveyor, they need be connected together essentially in the same way as the conveyor connection so that a non-processed veneer sheet can be tenderized in advance by the tenderizer. The transfer path extending substantially as far as the tenderizer 15, 16 includes a deceleration section which covers an upstream length of the transfer path. This deceleration section has a drive source 19 and speed-reducing mechanisms 20 and 21 operating such that the second roller pair 17' rotates at a speed lower than that of the first roller pair 17 and the third roller pair 17" at a speed lower than that of the second. Accordingly, the veneer sheet travelling through this particular section of the transfer path will be compressed by the transfer roller pairs. In the rest of the transfer path, a fourth roller pair and onward will operate at the same speed as the third roller pair 17" and convey the veneer sheet while maintaining the compressed state. In the meantime, hot air is circulated through the space enclosed by heat insulating walls 22 so as to dry the veneer sheet under compression. Denoted by the reference numerals 10 and 11 are a log and a cutting knife, respectively. This cutting station may be connected to the tenderizer 15, 16 either directly or through any known processing step. In this way, where compression is applied to a veneer sheet which is being transferred, a deceleration transfer passage using speed-reducers is defined from a certain point on the transfer path over to a certain downstream point. Then, as clearly understood from FIG. 7, a veneer sheet is compressed by the first roller pair 17 to the third roller pair 17" progressively and maintains a certain degree of its compressed state even after having moved past the third pair of rollers. This permits the compression of the veneer sheet until the compression stress in the veneer sheet reaches zero due to drying. In this case, the drying step P using heating means proceeds in combination with the compressing step R and the tenderizing step Q takes place in a position substantially upstream of the drying and compressing station in the transfer path. Naturally, the tenderizer may be located in the space defined by the walls 22 in order to tenderize a veneer sheet during drying. In any case, the tenderizer is preferably located within the deceleration section of the transfer path or in a position upstream of the deceleration section to promote easy compression and, therefore, simplification of the mechanical arrangement.

It will be appreciated from the above that, of systems using the aforementioned process a system for continuously processing a veneer sheet basically includes a transfer path conveying the veneer sheet, a deceleration section covering a certain upstream length of the transfer path and using deceleration mechanisms, a tenderizer located in a suitable upstream position inclusive of the deceleration section, and suitable heating means facing the transfer path inclusive of the deceleration section. The guide plates 18 employed in combination with roller pairs in FIG. 7 may be replaced by piano wires or like similar elongated elements extending along the lower surface or the lower and upper surfaces of a veneer sheet so long as they define the transfer path together with the roller pairs. Such guide means can be in practice omitted depending on the spacing between adjacent ones of the roller pairs. Furthermore, the deceleration section of the transfer path need not always be defined in an inlet portion of the transfer path as illustrated. Rather, it is preferable for the deceleration section to extend from a position where the moisture content of a veneer sheet becomes substantially 30% and causes it to shrink noticeably over to a position downstream of the first position.

Figure 8:
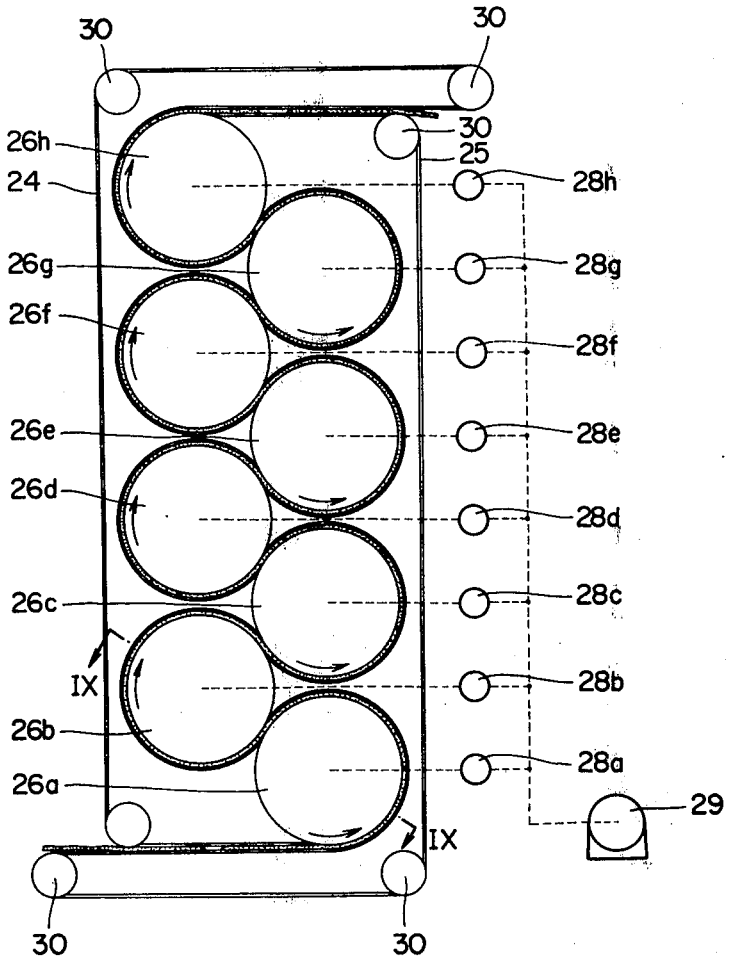
FIGS. 8–10 show another preferred embodiment of the present invention in side elevation, fragmentary front elevation and fragmentary section, respectively.
Figure 9:
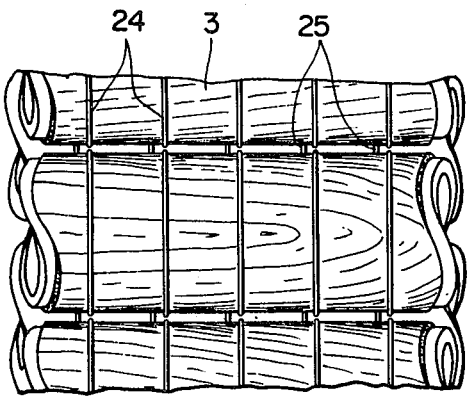

FIG. 8 shows in side elevation another veneer sheet processing system representing a preferred drying device. FIG. 9 shows this system in fragmentary front elevation and FIG. 10 in a section along line X—X of FIG. 8. The illustrated arrangement is concerned with a drying device of heat plate type for carrying out the aforementioned process according to the present invention. This type of drying device has been impracticable because it restrains a veneer sheet with relatively large strength and thereby causes noticeable cracks in the veneer sheet during drying. The present invention readily makes it practicable by applying the drying principle discussed and further improving it to promote drying of a veneer sheet in the course of the transfer.

Figure 10:
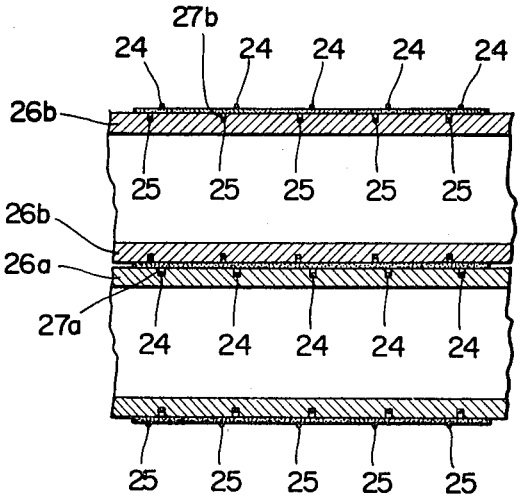

Referring to FIGS. 8–10, the system includes two sets of multiple elongated elements 24 and 25, such as coil springs which are passed over a plurality of rollers **26*a*–26*h* to define a zigzag transfer path while sandwiching a veneer sheet 23 therebetween. Each of the rollers 26*a*–26*h* has on its periphery multiple annular channels in which those elongated members closer to the roller than the veneer sheet 23 are received to become entirely hidden therein. For example, as partly shown in FIG. 10, the roller 26*a* is formed with annular channels 27*a* and the roller 26*b* is formed with annular channels 27*b*. The veneer sheet 23 is thus directly engaged with the peripheral surfaces of the individual rollers. The rollers 26*a*–26*h* are individually heated by steam or the like from the inside and connected through speed-reducing mechanisms 28*a*–28*h* with a drive source 29. The rotational speed progressively decreases from the most upstream roller over to the most downstream roller with respect to the intended direction of transfer thereby defining a deceleration transfer section. The reference numeral 30 denotes rollers for turning the running directions of the elongated elements 24 and 25**.

In operation, the rollers **26*a*–26*h* are driven in the directions indicated by the arrows to transfer the veneer sheet 23 while heating the veneer sheet. At the same time, the rollers rotating at successively decreased speeds compress the veneer sheet at the respective shift points from one roller to another. Accordingly, splits due to drying can be reasonably suppressed by the simultaneous drying and compression even without a tenderizer. More effective prevention of splits is achievable by so controlling the speed-reducer mechanisms 28*a*–28*h* as to carry out deceleration transfer matching with the contraction of various parts of the veneer sheet. Additionally, the illustrated system conveys the veneer sheet 23** in a desirable manner. Since the elongated elements guide the veneer sheet from one roller to another holding it therebetween, the system overcomes possible defects in the veneer sheet such as rotten spots and knotholes in smoothly conveying the veneer sheet without any dislocation or lifting from the heated rollers. This also holds when the veneer sheet has a relatively narrow width. The system is therefore free from jamming of the veneer sheet and like troubles and favourable from the viewpoint of practical use.

To conform with the drying principle of the invention, the tenderizer will be located in a suitable position which is basically in or ahead of the drying station. Preferably, it may occupy a position within the deceleration section or a suitable position ahead of the deceleration section such as one independent of the deceleration section to introduce a veneer sheet therefrom in the manner shown in FIG. 8. In practice, through not shown, the tenderizer may be positioned in the vicinity of the inlet of the system shown in FIG. 8 or immediately past of a veneer lathe located in a further upstream position or may be replaced by a veneer lathe of the type which tenderizes a veneer sheet while cutting it off from a log. When located in the drying station, the tenderizer may take the form of a tenderizing roller with piercing elements and afforded by the roller **26*a* of FIG. 8. Alternatively, the tenderizer in the drying station may utilize the speed-reducer mechanisms 28*a* and 28*b* and cause the latter 28*b* to rotate at a higher speed than the former 28*a* so that their associated rollers 28*b* and 28*a*** slightly pull a veneer sheet therebetween to enlarge splits in the veneer sheet.

Meanwhile, it is not a prerequisite to employ all of the rollers **26*a*–26*h*** in FIG. 8 for constituting the deceleration section. For example, some of the speed-reducers shown may be omitted in order to define the deceleration section by a suitable number of the speed-reducers and their associated rollers. The deceleration section will become particularly effective when designed to cover the region from a position where the moisture content of a veneer sheet is substantially 30% to a certain downstream position. The individual speed-reducers may be driven at a variable speed reduction ratio to cope with various moisture contents and various degrees of contraction of the veneer sheets. The compression may be performed in relation with the condition of a veneer sheet processed by a tenderizer with a view to providing optimum compression. To simplify the system, the rollers may have their diameters varied to constitute a substantial speed-reducing mechanism.

This system not only achieves the advantages inherent in the basic process discussed but operates with excellent efficiency because a veneer sheet directly contacts heated roller surfaces to be dried while having its opposite surfaces turned over repeatedly. The result is a drying step which consumes only a short period of time and a low cost. Moreover, due to the smooth transfer of a veneer sheet, a desired length of heating plate can be obtained merely by installing numerous additional rollers of small diameters. The transfer of a veneer sheet from one roller to another occurs smoothly.

As viewed in FIG. 9, the elongated elements 24 and 25 will be installed in numbers matching the width of the veneer sheet 23. Coil springs are preferable as the elongated elements because they will desirably transfer a veneer sheet even in the deceleration section without slipping on the veneer sheet or in the annular channels on the rollers. Where coil springs or the like constitute the elongated elements, the two vertical series of rollers in FIG. 8 may be spaced a little distance from each other to make the transfer of a veneer sheet from one roller to another, smoother.

Next, the tenderizer of FIGS. 2 and 3 will be described in more detail.

Figure 11:
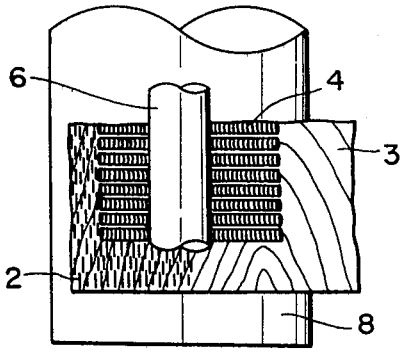
FIG. 11 is a partly cut away plan view of FIG. 3.
Figure 12:
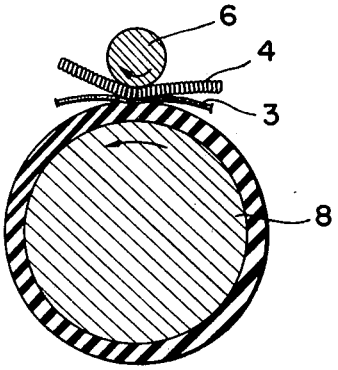
FIG. 12 is a side elevation of the tenderizing device shown in FIG. 11.
Figure 13:
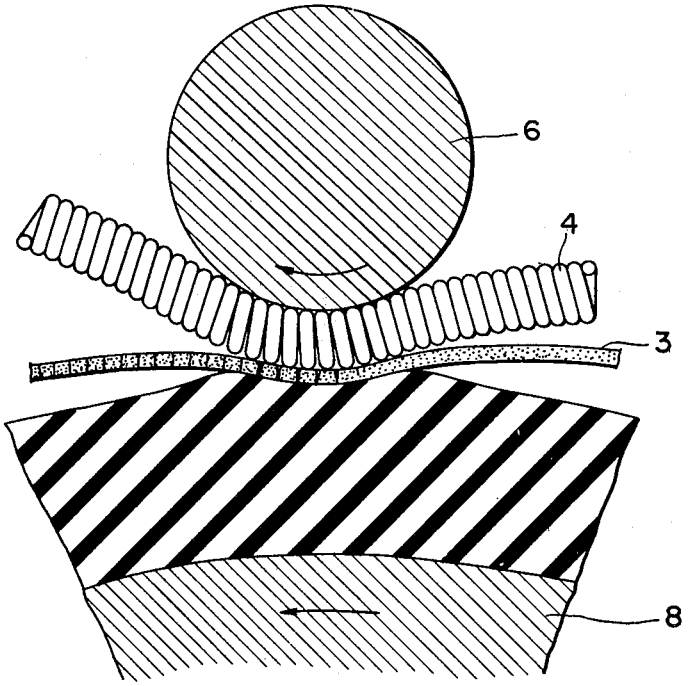
FIG. 13 is a fragmentary enlarged side elevation of the tenderizing device.

Referring to FIGS. 11–13, a tenderizing device according to the present invention includes a plurality of parallel extensible members 4 or flexible bellows like coil springs. These extensible members of coil springs 4 extend perpendicular to the axis of a roller 8 so that a path for conveying a veneer sheet 3 is defined between the coil springs 4 and roller 8. The roller 8 has its outer periphery covered with an elastic layer made of rubber for example and is driven for rotation to transfer the veneer sheet 3. A roller or like sylindrical pressing member 6 is located at the back of the coil spring 4 and presses them towards the roller 8 whereby the coil springs 4 moving with the veneer sheet 3 are pressed against the surface of the veneer sheet.

With this device, the presser roller 6 causes the coil springs 4 to bend towards the roller 8 together with the veneer sheet 3 and thereby enlarges the spacing between the adjacent turns of each coil spring. More specifically, those portions of the coil springs 4 engaged with the veneer sheet 3 stretch in their lengthwise direction. This locally subjects the veneer sheet 3 to a tensile force with the result that small splits 2 are formed in the veneer sheet. Such splits 2 will be formed successively in the veneer sheet in accordance with the rotation of the roller 8. It will be noted that, since the magnitude of the tensile force acting on the veneer sheet depends on the opening degree of the adjacent turns of the coil springs in the bent position, the splits 2 can be provided to the veneer sheet substantially regardless of various conditions such as thickness, strength and transfer speed of the veneer sheet as well as presence/absence of cracks at the back of the veneer sheet and orientation of the back cracks if present. Meanwhile, the elastic layer on the roller 8 assists in forming and enlarging the splits 2 from the side of the veneer sheet 3 opposite to the coil springs 4 due to its local variation in speed which results from deformation. This, however, does not help enlarge the splits beyond a necessary degree because the extension of the splits 2 is regulated by the coil springs 4. For this reason and since the splitting caused by tension does not accompany a cut across the grain of the veneer sheet, the illustrated device offers quite an effective and adequate tendering effect inclusive of extension without detriment to the strength of a veneer sheet.

Figure 17:
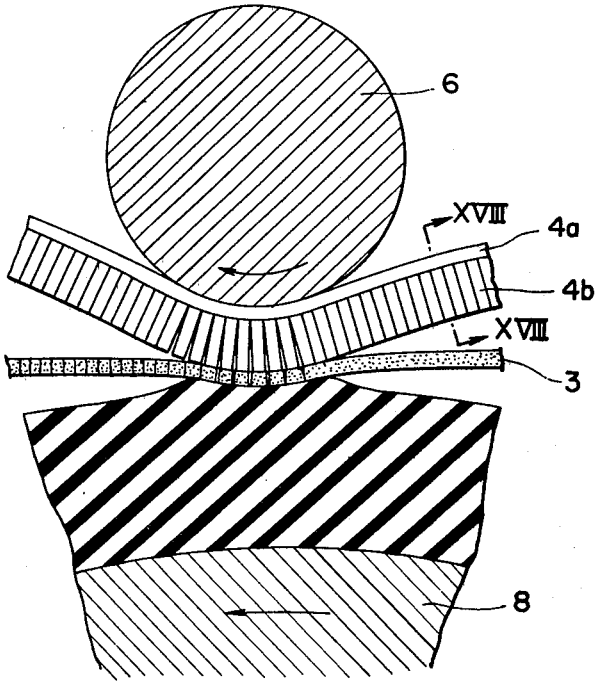
FIG. 17 is a fragmentary enlarged side elevation showing modified extensible members.
Figure 18A:
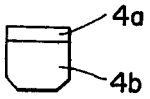
FIGS. 18(*a*)–18(*c*) are sections along line XVIII—XVIII of FIG. 17 and showing various examples of the extensible members.
Figure 18B:
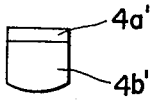
Figure 18C:
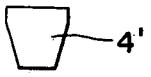

The coil springs are an example of the extensible members 4 which is the most preferable in forming minute splits, increasing the applicable range of the device and promoting easy maintenance. FIG. 17 illustrates an alternative example of the extensible members which comprises a number of blocks 4*b* arranged along the lengthwise direction of the extensible members in an intimately engaged or slightly spaced relation. The blocks 4*b* are connected together by a belt 4*a* of a relatively hard material at their one side. Each block 4*b* may have a section shown in FIG. 18*a* or 18*b*; the blocks 4*b* and belt 4*a* may even be formed integrally of a hard resin or hard rubber for instance as shown in FIG. 18*c* with the blocks arranged into a comb like configuration. Any other arrangements may be employed for the extensible members 4 insofar as they have those portions pressingly engagable with a veneer sheet aligned in the lengthwise direction and the spacing between said adjacent engagable portions can be increased by bending of the extensible members as discussed. It will be recalled that the magnitude of the tension or the dimension of the small splits depends on the opening degree of the neighboring portions of the extensible members in the bent positions. It is thus preferable to select the spacing of the adjacent engaging portions, the length (thickness) of each engaging portion and the like according to a specific application and in consideration of the bending degree attributable to the presser roller. Preferably, the extensible members are located at suitable spacings as shown in FIG. 11 in order to avoid interference between adjacent extensible members and that between neighboring splits. Where the extensible members are endless, the whole device will become favorably small in size. Coil springs are usually formed of iron or an alloy of iron, but such a metal reacts the sap and the like of veneer sheets to change the color of the veneer sheets into brown. Hence, where the device is operated for tenderizing a fresh veneer sheet, it is preferable to use coil springs whose outer surfaces carry rubber layers or plated layers provided such covering layers do not prevent resilient actions of the coil springs. If desired, the coil springs may be bodily made of stainless steel which is inactive to the sap. In any case, a greater effect is achievable by selecting coil springs in consideration of the conditions of a veneer sheet to be processed, intended application of the processed veneer sheet etc.

Concerning the presser member, it should preferably be a rigid member to positively bend the extensible members and its curvature should be suitably determined because the curvature would affect the opening degree of the engaging portions of the extensible members. However, the curvature is not limited to a constant one as that of the presser roller. If use is made of a freely rotatable pressure roller having a polygonal or elliptic cross-section for example, splits in a veneer sheet can be conditioned in a desired manner by the adjustable magnitude and acting point of the tension. Furthermore, the freely rotatable presser roller may be replaced by a non-rotatable pressing member. Generally, the veneer sheet 3 is conveyed by the rotation of the roller 8. Where another member is installed in the device for moving the veneer sheet 3, the roller 8 will need no drive mechanisms and be only free to rotate.

Figure 14:
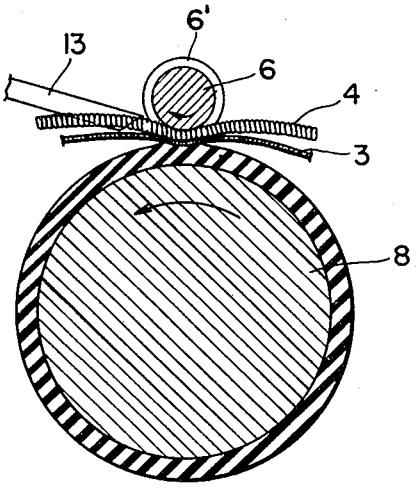
FIG. 14 shows a modification to the embodiment of FIG. 3.

Meandering and like actions of the extensible members 4 would cause the extensible members to interfere with each other and excessively press the veneer sheet. To prevent this, the presser member 6 may have radially outward flanges 6′ of a radial dimension less than the thickness of the extensible members and serving to guide and stop the extensible members 4 as depicted in FIG. 14. Alternatively, annular recesses (not shown) may be formed on the presser member 6 to serve the same purposes. If necessary, a supporting member (not shown) may be located at the back of the presser member 6 in order to avoid flexing of the presser member attributable to its pressing action.

It may occur that, when the extensible members 4 are released from the bending force to have their adjacent engaging portions closed again, they nip fine fibers of the veneer sheet between their adjacent turns and carry the veneer sheet therewith along their running direction. This can be avoided if as shown in FIG. 13 the presser member 6 and extensible members 4 are so located that the adjacent turns of each extensible member close at a position downstream of the presser member 6 with respect to the direction of veneer sheet conveyance and where the veneer sheet will have become fully released from the extensible members. The problem can also be settled by locating a separating member 13 in a position downstream of the presser member 6 as indicated in FIG. 14. Additionally, it is permissible to design the presser member 6 and roller 8 to be movable away from each other under a predetermined level of pressure with a view to coping with unusual pressure forces which may result from overlapping or the like of a veneer sheet.

Figure 15:
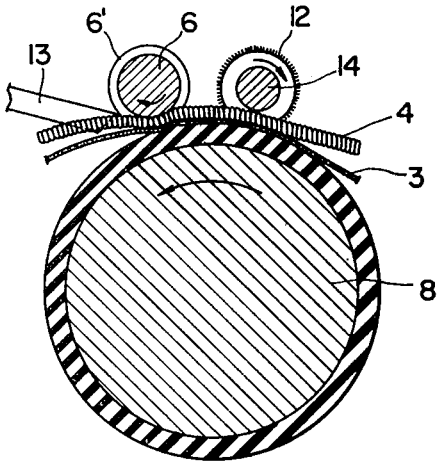
FIG. 15 shows in side elevation another modification.
Figure 16:
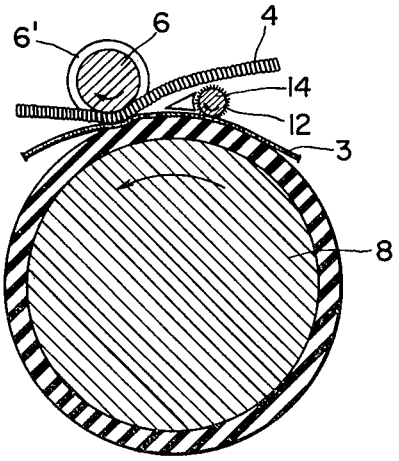
FIG. 16 is a side elevation of an alternative arrangement to the device of FIG. 15.

Second and third embodiments of the present invention are illustrated in FIGS. 15 and 16. Each of these embodiments includes, in addition to the various component parts of the first embodiment, a piercing roller 14 in the transfer path of a veneer sheet upstream of the presser member 6. The roller 12 has numerous short piercing elements 13 on its outer periphery and opposes the roller 2 in such a manner as to cut into the veneer sheet 3 while presenting the same.

With this alternative design, the piercing elements 12 on the roller 14 form numerous cuts (not shown) in the veneer sheet 3 with the rotation of the roller 8. Then the presser roller 6 urges the extensible members 4 towards the roller 8 together with the veneer sheet 3 whereby the turns of the members 4 are opened in contact with the veneer sheet as stated to exert local tension to the veneer sheet. Since cuts provided by roller 14 are now present in the veneer sheet 3, the tension concentrates on the relatively weak cuts and successively forms splits each starting from the cut.

Thus, splits in the veneer sheet start from individual cuts provided by the roller 14 and therefore can be formed easily and positively. The cuts in the veneer sheet serve only to cause the tension originating from bending of the extensible members 4 to concentrate to each local portion while the splits or slits are formed strictly by the tension. For this reason and because the extensible members 4 regurate the extension of the splits, growth of the splits beyond a given limit is prevented. Where the cuts in the veneer sheet have irregular distributions in size, depth etc., a traditional tenderizing device merely added with the piercing roller applicable to the present invention or like roller will further promote such irregular distributions and thereby bring about various problems such as fall in the strength of the veneer sheet and breakage of the veneer sheet. The device of the invention is free from this kind of drawback and offers a far more improved tenderizing and extending effect.

By suitably locating the piercing elements 12 on the roller 14, for example in a zigzag pattern, splits neighboring each other along the grain of a veneer sheet are prevented from communicating with each other in a more positive way. This suggests the possibility for increased degrees of tenderness and extension of a veneer sheet without an accompanying fall in the strength, breakage or the like. Designed only to form cuts in a veneer sheet, the short piercing elements on the roller 14 can be arranged densely enough to effectively and adequately form splits even in very thin veneer sheets (thickness usually ranging from 0.5 mm to 1 mm) which conventional tenderizing devices have been incapable of processing.

Each piercing element 12 may be in any desired shape such as a needle shape, a cone, a pyramid or a wedge shape as long as it definitely forms cuts in a veneer sheet without unnecessarily cutting of the grains. Also, its height and others on the roller 14 may be suitable determined according to a specific application. It is preferable, for preventing the veneer sheet from being conveyed round the circumference of the roller 14 which has cut into the veneer sheet, to so locate the extensible members 4 as to guide the veneer sheet towards the roller 8 in the transfer path downstream of the roller 14 as viewed in FIG. 15 or, as shown in FIG. 16, to position a guide in the transfer path downstream of the roller 14 in the same way. Meanwhile, the extensible members 4 may extend somewhat longer along the outer periphery of the roller 8 as viewed in FIG. 15 in a position upstream of the presser roller 6 or the presser roller 6 and roller 14. Then the resultant transfer path will promote very accurate transfer of a veneer sheet and create a precautionary measure against the meandering of the veneer sheet which might occur due to the formation of splits or cuts.

Figure 19:
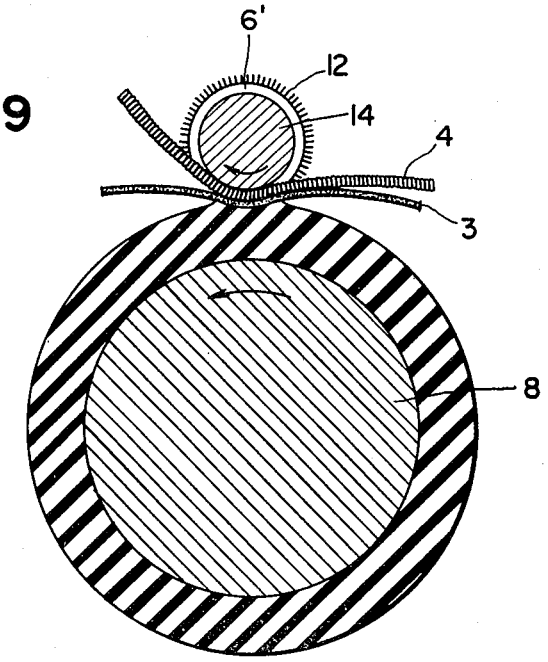
FIGS. 19 and 20 illustrate in side elevation a further modification of FIG. 3.
Figure 20:
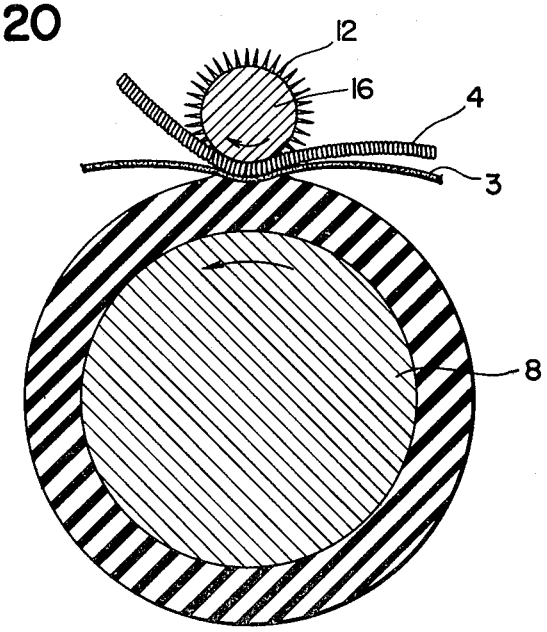

A further tenderizing device according to the present invention is shown in FIG. 19 and which has a combined presser and piercing roller 12. This roller 14 is intended to press the extensible members 4 and cut into a veneer sheet simultaneously. For this purpose, the roller 12 is positioned on the side of the extensible members 4 opposite to the roller 8 in such a manner as to force the extensible members towards the roller 8 and press and cut into the veneer sheet through the gaps between neighboring parallel extensible members. Short piercing elements 12 may be formed on the periphery of each of multiple flanges 6' which are arranged at equally spaced axial locations on the roller 14 (see FIG. 19). Alternatively, such piercing elements 12 may be directly studded on the roller 14 (see FIG. 20). The roller 14 which is freely rotatable allows its elements 12 to engage the veneer sheet 3 before the extensible members 4 are bent to cause splitting of the veneer sheet. Accordingly, numerous splits or slits will be formed successively starting from the cuts provided by the elements 12. While achieving substantially the same effect as the device shown in FIGS. 15 and 16, the device according to this embodiment simplifies the mechanism and therefore offers additional effects because it allots the function of forming cuts and that of forming splits to a single common roller. The piercing elements 12 press and cut into the veneer sheet through between the parallel extensible members 4. Due to this arrangement and if the elements 12 are rigid as in the case of FIGS. 19 and 20, the roller 12 can allow the flanges 6' or the elements 6' to also serve as a guide for avoiding meandering of the members 4.

In summary, a tenderizing device according to the present invention forms numerous small splits effectively and adequately regardless of the physical properties, thickness and cracks on the back of a veneer sheet, orientation of the back cracks, transfer speed of a veneer sheet and other conditions which have obstructed versatile application of conventional devices. The device of the invention thus offers a marked tenderizing and extending effect and greatly contributes to the progress of the art of plywood production.

What is claimed is:

1. An apparatus for drying a veneer sheet comprising:

means for feeding a veneer in a predetermined direction having a normal speed transfer section and a deceleration transfer section provided on a downstream side of said normal speed transfer section;

a tenderizing device for forming numerous small splits on the veneer sheet and located in at least one of said normal speed transfer section and said deceleration transfer section; and heating means provided in said deceleration transfer section for drying the veneer sheet therewithin.

2. An apparatus for drying a veneer sheet comprising:

a plurality of rollers arranged in two rows staggered such that said rollers have respective axes parallelly extending in corners of a zigzag path and any two adjacent rollers define veneer passages between peripheries thereof, said rollers being driven to feed veneers in a predetermined direction;

plural sets of elongate elements passed over said rollers in sequence along said zigzag path, each set holding a veneer sheet therebetween, said rollers having on peripheral surfaces thereof annular recesses adapted to fully receive roll side elements in said sets, said rollers being heated;

selected rollers being driven at successively decreasing speeds toward said predetermined direction to form a deceleration section; and a tenderizing device for forming numerous small splits in veneer sheet and located in an upstream portion inclusive of said deceleration section with respect to said predetermined direction.

3. An apparatus as claimed in claim 2, wherein said elongated elements includes resilient elongated elements such as coil springs.

4. An apparatus as claimed in claim 2 or 3, wherein said speed-reducing mechanisms are operable at a variable speed reduction ratio.

* * * * *